US007789168B2

(12) United States Patent
Becht et al.

(10) Patent No.: US 7,789,168 B2
(45) Date of Patent: Sep. 7, 2010

(54) VIBRATION REDUCTION APPARATUS FOR POWER TOOL AND POWER TOOL INCORPORATING SUCH APPARATUS

(75) Inventors: Reimund Becht, Hünfelden (DE); Norbert Hahn, Hühnstetten-Limbach (DE); Michael Stirm, Oberursel (DE); Ralf Seebauer, Selters (DE)

(73) Assignee: Balck & Decker Inc., Newark, DE (US)

( * ) Notice: Subject to any disclaimer, the term of this patent is extended or adjusted under 35 U.S.C. 154(b) by 86 days.

(21) Appl. No.: 12/055,971

(22) Filed: Mar. 26, 2008

(65) Prior Publication Data

US 2008/0185163 A1 Aug. 7, 2008

(51) Int. Cl.
*B25D 17/24* (2006.01)
*B25D 17/00* (2006.01)

(52) U.S. Cl. ..... 173/162.2; 173/162.1

(58) Field of Classification Search ..... 173/162.2, 173/162.1

See application file for complete search history.

(56) References Cited

U.S. PATENT DOCUMENTS 3,637,029 A * 1/1972 Sherwood et al. ..... 173/162.2
3,652,074 A * 3/1972 Frederickson et al. ..... 267/137
3,698,455 A * 10/1972 Frederickson et al. ..... 30/381
3,889,763 A * 6/1975 Dillon ..... 173/162.1
4,102,410 A * 7/1978 Ross ..... 173/133
4,401,167 A * 8/1983 Sekizawa et al. ..... 173/162.1
4,402,369 A * 9/1983 Nikitin et al. ..... 173/18
4,576,241 A * 3/1986 Emonet ..... 173/162.2
4,667,749 A * 5/1987 Keller ..... 173/162.2
4,673,043 A * 6/1987 Greppmair ..... 173/162.2
5,054,562 A * 10/1991 Honsa et al. ..... 173/210
5,697,456 A * 12/1997 Radle et al. ..... 173/162.2
5,947,211 A * 9/1999 Jakobsson ..... 173/210
6,076,616 A * 6/2000 Kramp et al. ..... 173/162.2
6,148,930 A * 11/2000 Berger et al. ..... 173/162.2
6,766,868 B2 * 7/2004 Frauhammer et al. ..... 173/48
2003/0037937 A1 * 2/2003 Frauhammer et al. ..... 173/48
2004/0040729 A1 * 3/2004 Meixner ..... 173/162.2
2004/0231867 A1 * 11/2004 Becht et al. ..... 173/162.2
2008/0289842 A1 * 11/2008 Chapple et al. ..... 173/162.2

* cited by examiner

*Primary Examiner*—Brian D Nash
(74) *Attorney, Agent, or Firm*—Kofi Schulterbrandt; Adan Ayala; Scott B. Markow

(57) ABSTRACT

The disclosure describes a handle assembly for a power tool that includes attachment means for attaching the assembly to a housing of a power tool. The handle means is adapted to be held by a user of the power tool and the handle means is mounted to the attachment means and is capable of limited movement relative to the housing of the power tool. The vibration damping means acts between said housing and said handle means. The vibration damping means can also comprise elastomeric material. The attachment means can be mounted in use to the housing via a bolt on one of the attachment means and the housing passing through a respective aperture in the other of said attachment means and the housing. At least some of the elastomeric material is arranged in use between at least one said bolt and a corresponding said aperture. The handle means can be pivotable and/or slidable relative to said attachment means. The vibration damping means can comprise at least one spring (e.g., compression/spring or torsion spring).

3 Claims, 5 Drawing Sheets

VIBRATION REDUCTION APPARATUS FOR POWER TOOL AND POWER TOOL INCORPORATING SUCH APPARATUS

FIELD OF THE INVENTION

The present invention relates to a vibration reduction apparatus for a power tool and to a power tools incorporating such apparatus. The invention relates particularly, but not exclusively, to vibration reduction apparatus for powered hammers, and to hammers incorporating such apparatus.

BACKGROUND OF THE INVENTION

Electrically driven hammers are known in which a driving member in the form of a flying mass is reciprocally driven in a piston, and impact of the flying mass against the end of the piston imparts a hammer action to a bit of the hammer. Such an arrangement is disclosed in European patent application EP1252976 and is shown in FIG. 1.

Referring in detail to FIG. 1, the prior art demolition hammer comprises an electric motor 2, a gear arrangement and a piston drive arrangement which are housed within a metal gear housing 5 surrounded by a plastic housing 4. A rear handle housing incorporating a rear handle 6 and a trigger switch arrangement 8 is fitted to the rear of the housings 4, 5. A cable (not shown) extends through a cable guide 10 and connects the motor to an external electricity supply. When the cable is connected to the electricity supply when the trigger switch arrangement 8 is depressed, the motor 2 is actuated to rotationally drive the armature of the motor. A radial fan 14 is fitted at one end of the armature and a pinion is formed at the opposite end of the armature so that when the motor is actuated the armature rotatingly drives the fan 14 and the pinion. The metal gear housing 5 is made from magnesium with steel inserts and rigidly supports the components housed within it.

The motor pinion rotatingly drives a first gear wheel of an intermediate gear arrangement which is rotatably mounted on a spindle, which spindle is mounted in an insert to the gear housing 5. The intermediate gear has a second gear wheel which rotatingly drives a drive gear. The drive gear is non-rotatably mounted on a drive spindle mounted within the gear housing 5. A crank plate 30 is non-rotatably mounted at the end of the drive spindle remote from the drive gear, the crank plate being formed with an eccentric bore for housing an eccentric crank pin 32. The crank pin 32 extends from the crank plate into a bore at the rearward end of a crank arm 34 so that the crank arm can pivot about the crank pin 32. The opposite forward end of the crank arm 34 is formed with a bore through which extends a trunnion pin 36 so that the crank arm 34 can pivot about the trunnion pin 36. The trunnion pin 36 is fitted to the rear of a piston 38 by fitting the ends of the trunnion pin 36 into receiving bores formed in a pair of opposing arms which extend to the rear of the piston 38. The piston is reciprocally mounted in cylindrical hollow spindle 40 so that it can reciprocate within the hollow spindle. An O-ring seal 42 is fitted in an annular recess formed in the periphery of the piston 38 so as to form an airtight seal between the piston 38 and the internal surface of the hollow spindle 40.

When the motor 2 is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate 30 and the crank arm arrangement comprising the crank pin 32, the crank arm 34 and the trunnion pin 36 converts the rotational drive from the crank plate 30 to a reciprocating drive to the piston 38. In this way the piston 38 is reciprocatingly driven back and forth along the hollow spindle 40 when the motor is actuated by a user depressing the trigger switch 8.

The spindle 40 is mounted in magnesium housing 42 from the forward end until an annular rearward facing shoulder (not shown) on the exterior of the spindle butts up against a forward facing annular shoulder (not shown) formed from a set of ribs in the interior of the magnesium casing 42. The ribs enable air in the chamber surrounding the spindle 40 to circulate freely in the region between ram 58 and beat piece 64. An increased diameter portion on the exterior of the spindle fits closely within a reduced diameter portion on the interior of the magnesium casing 42. Rearwardly of the increased diameter portion and the reduced diameter portion an annular chamber is formed between the external surface of the spindle 40 and the internal surface of the magnesium casing 42. This chamber is open at its forward and rearward ends. At its forward end the chamber communicates via the spaces between the ribs in the magnesium casing with a volume of air between the ram 58 and the beat piece 64. At its rearward end the chamber communicates via the spaces between the ribs 7 and the recess of the gear casing 5 with a volume of air in the gear casing 5.

The volume of air in the gear casing 5 communicates with the air outside of the hammer via a narrow channel 9 and a filter 11. The air pressure within the hammer, which changes due to changes in the temperature of the hammer, is thus equalised with the air pressure outside of the hammer. The filter 11 also keeps the air within the hammer gear casing 5 relatively clean and dust free.

A ram 58 is located within the hollow spindle 40 forwardly of the piston 38 so that it can also reciprocate within the hollow spindle 40. An O-ring seal 60 is located in a recess formed around the periphery of the ram 58 so as to form an airtight seal between the ram 58 and the spindle 40. In the operating position of the ram 58 (shown in the upper half of FIG. 1), with the ram located behind bores 62 in the spindle, a closed air cushion is formed between the forward face of the piston 38 and the rearward face of the ram 58. Reciprocation of the piston 38 thus reciprocatingly drives the ram 58 via the closed air cushion. When the hammer enters idle mode (i.e. when the hammer bit is removed from a work piece), the ram 58 moves forwardly, past the bores 62 to the position shown in the bottom half of FIG. 1. This vents the air cushion and so the ram 58 is no longer reciprocatingly driven by the piston 38 in idle mode, as is known to persons skilled in the art.

However, known hammer drills of this type suffer from the drawback that the hammer action generates significant vibrations, which can be harmful to users of the apparatus, and can cause damage to the apparatus itself.

Preferred embodiments of the present invention seek to overcome the above disadvantages of the prior art.

BRIEF SUMMARY OF THE INVENTION

According to an aspect of the present invention, there is provided a handle assembly for a power tool, the handle assembly comprising:

attachment means for attaching the assembly to a housing of a power tool;

handle means adapted to be held by a user of the power tool, wherein the handle means is mounted to said attachment means and is capable of limited movement relative to the housing of the power tool; and vibration damping means acting between said housing and said handle means.

By providing vibration damping means acting between the housing and a handle means capable of limited movement relative to the housing, this provides the advantage of enabling vibrations to be damped in a simple and cost effective manner.

The vibration damping means may comprise elastomeric material.

In a preferred embodiment, the attachment means is mounted in use to the housing via at least one bolt on one of the attachment means and the housing passing through a respective aperture in the other of said attachment means and the housing, wherein at least some of the elastomeric material is arranged in use between at least one said bolt and a corresponding said aperture.

The handle means may be mounted to at least one aperture in the attachment means, and at least some of the elastomeric material may be arranged between the handle means and at least one said aperture.

The handle means may comprise a pair of handles, each said handle being mounted to said attachment means via a respective pair of apertures defining a pair of non-parallel axes.

This provides the advantage of enabling more effective vibration damping to be achieved by damping movement in at least two non-parallel directions.

The handle means may be pivotable relative to said attachment means.

The vibration damping means may comprise at least one spring.

The handle means may be slidable relative to the attachment means and at least one said spring may be a compression spring arranged between said handle means and said attachment means.

The handle means may be pivotable relative to said attachment means and at least one said spring may be a compression spring arranged between said handle means and said attachment means.

The handle means may comprise a body portion pivotally connected to said attachment means via links pivoting about at least two substantially parallel axes.

This provides the advantage of enabling a parallelogram linkage to be formed such that bending of the spring is minimised.

At least one said spring may be a torsion spring connected between said handle means and said attachment means.

According to another aspect of the present invention, there is provided a power tool comprising a housing;

a motor in the housing for actuating a working member of the tool; and a handle assembly as defined above.

The power tool may be a hammer.

BRIEF DESCRIPTION OF THE DRAWINGS

Preferred embodiments of the invention will now be described, by way of example only and not in any limitative sense, with reference to the accompanying drawings, in which.

DETAILED DESCRIPTION OF THE INVENTION

Figure 1:
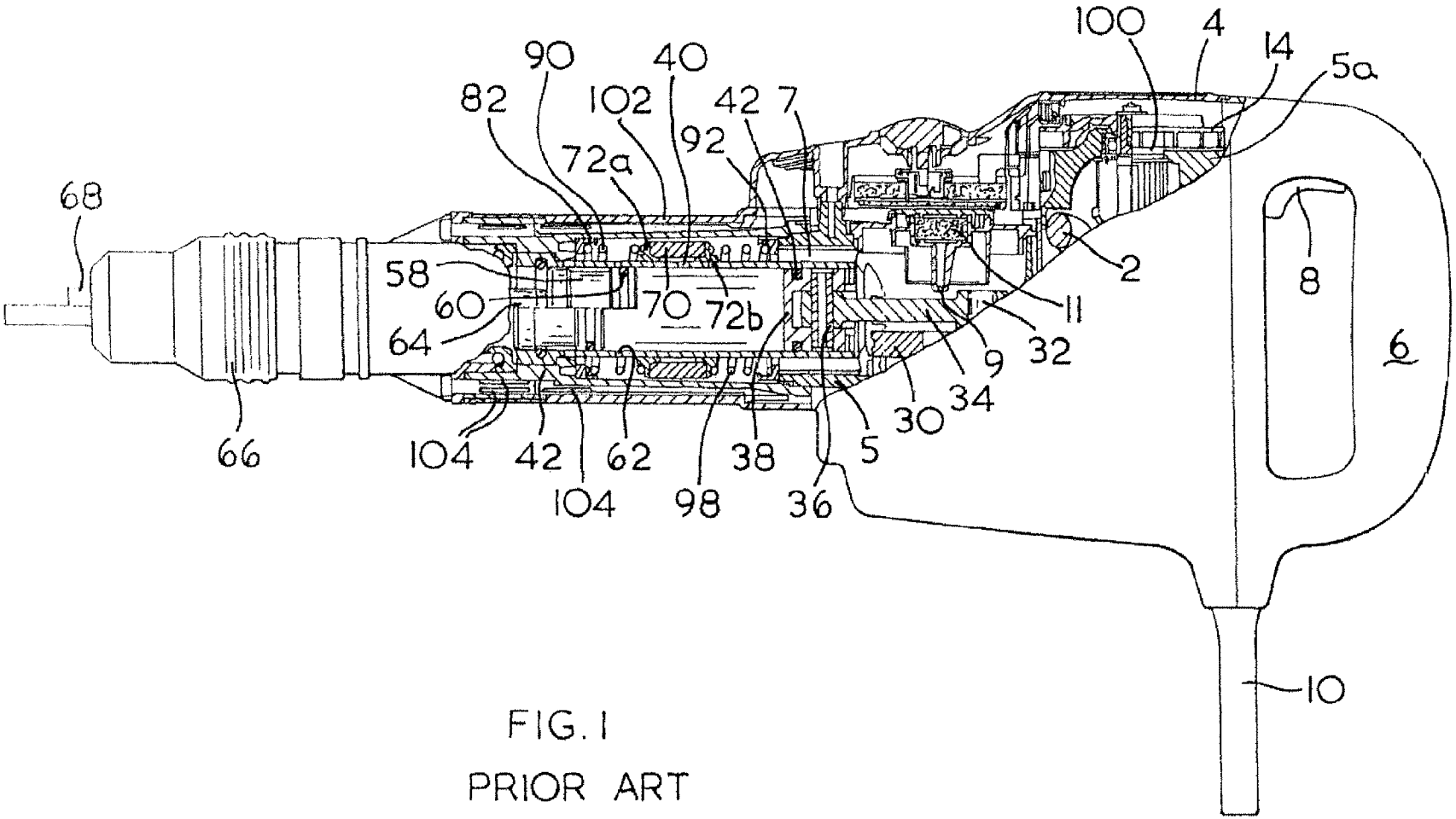
FIG. 1 PRIOR ART
FIG. 1 is a partially cut-away side view of a prior art demolition hammer.
Figure 2:
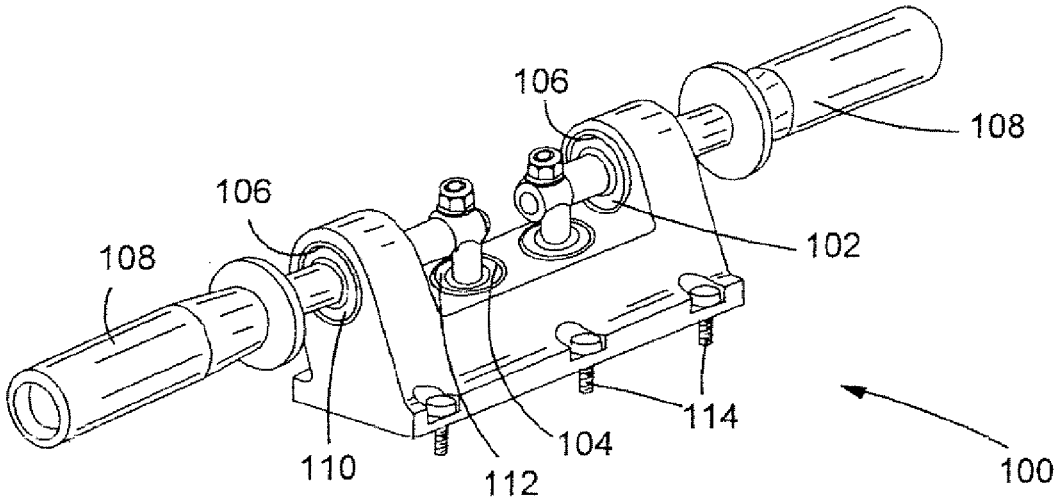
FIG. 2 is a handle assembly of a first embodiment of the present invention for use with a power hammer.

Referring to FIG. 2, a handle assembly 100 of a first embodiment of the invention for use with a power hammer (not shown) has a body portion 102 having a pair of apertures 104 in a horizontal surface thereof, and a pair of apertures 106 through vertically extending portions thereof. A pair of handles 108 are mounted to the body portion 102 via apertures 104, 106, the gaps between the walls of apertures 104 and the handles 108 being occupied by vibration damping elastomeric material 112 and the gaps between the handles 108 and the walls of apertures 106 being filled with vibration damping elastomeric material 110. The body portion 102 is rigidly mounted to a housing (not shown) of the power hammer by means of a series of bolts 114.

Because the only mechanical connection between handles 108 and the housing of the power hammer is via two sets of vibration damping material 110, 112, each of which damps vibration in a direction not parallel to the other, the amount of vibration transmitted to a user of the power hammer (i.e. holding the handles 108) is limited in an effective but cost efficient manner.

Figure 3:
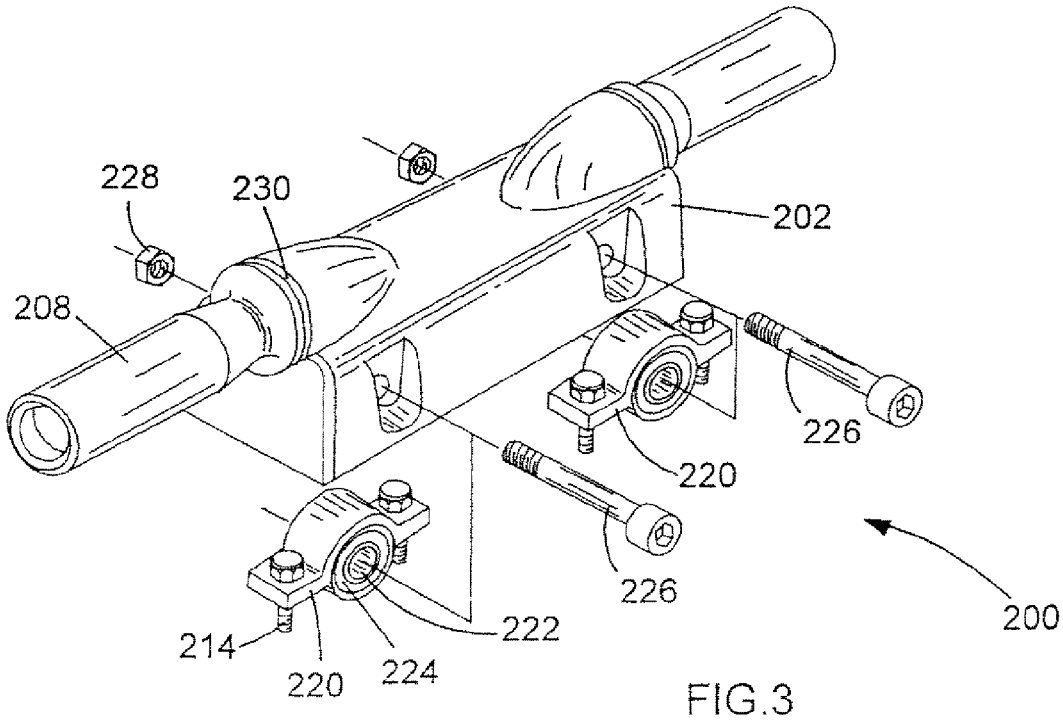
FIG. 3 is an exploded view of a handle assembly of a second embodiment of the present invention.

Referring now to FIG. 3, in which parts common to the embodiment of FIG. 2 are denoted by like reference numerals but increased by 100, a handle assembly 200 of a second embodiment of the present invention is mounted to a housing (not shown) of a power hammer by attaching brackets 220 to the housing via bolts 214. Each of the brackets 220 defines an aperture 222 accommodating vibration damping elastomeric material 224 and is received in a respective recess within body portion 202 and mounted thereto by means of bolts 226 passing through apertures 222 and corresponding nuts 228, such that the vibration damping material 224 occupies the gaps between bolts 226 and the walls of apertures 222. The handles 208 are connected to the body portion 202 by means of vibration damping elastomeric material 230 which act to damp vibrations along a direction generally at right angles to the direction of vibrations damped by elastomeric material 224. The present invention therefore also damps vibrations from the housing of the power hammer by means of vibration damping material 224, 230 arranged around non-parallel axes.

Figure 4:
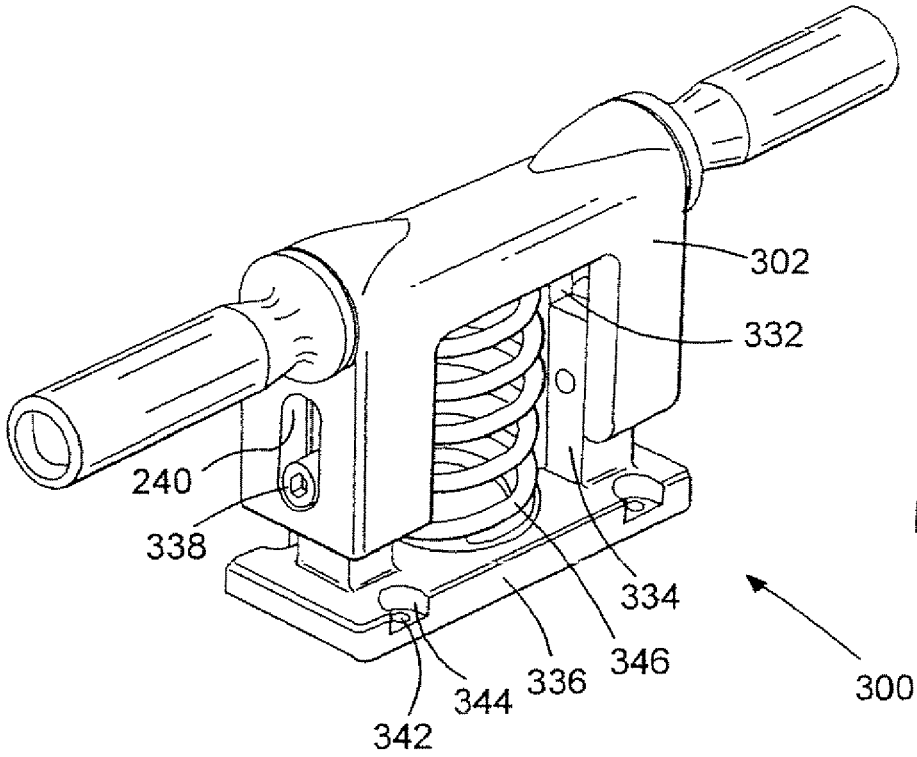
FIG. 4 shows a handle assembly of a third embodiment of the present invention.

Referring now to FIG. 4, in which parts common to the embodiment of FIG. 3 are denoted by like reference numerals but increased by 100, a handle assembly 300 of a third embodiment of the present invention has a body portion 302 having channels 332 on its underside to which columns 334 of a support 336 are attached by means of bolts 338 such that the body 302 can slide vertically relative to the support 336 by an amount limited by the length of slots 340. The support 336 is attached to a housing of the power hammer by means of bolts (not shown) which fit within holes 342 located in recesses 344. The body portion 302 and support 336 are urged apart by means of a compression spring 346.

Figure 5:
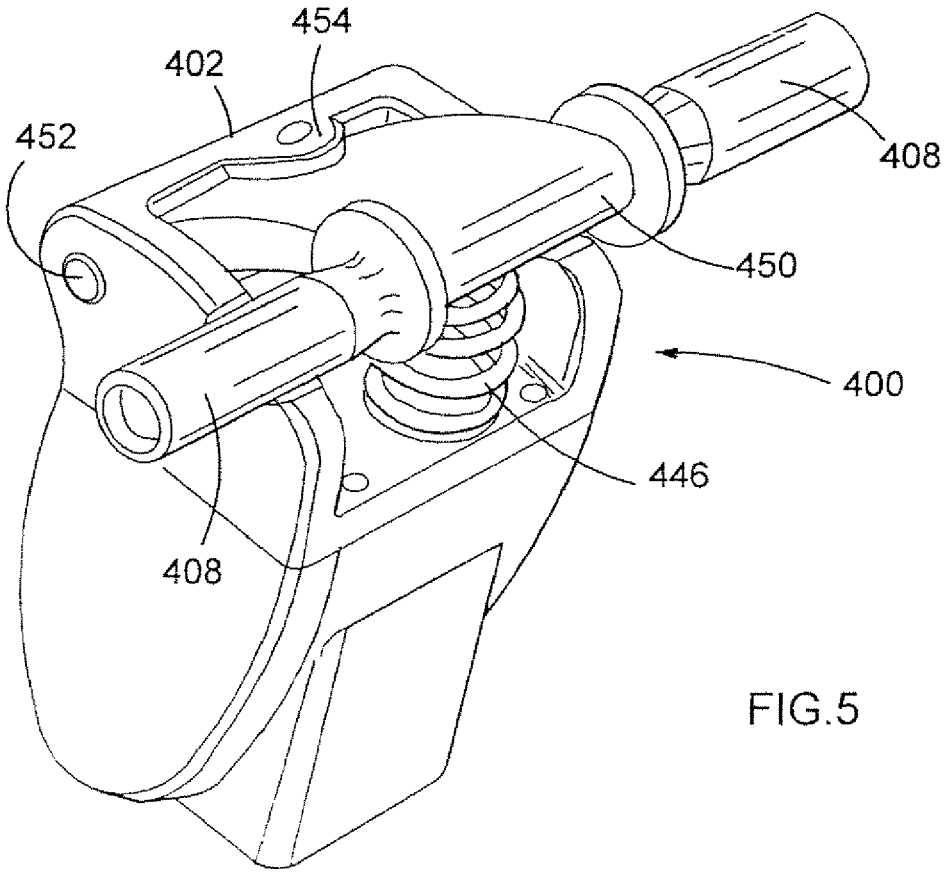
FIG. 5 shows a handle assembly of a fourth embodiment of the present invention.

Referring now to FIG. 5, in which parts common to the embodiment of FIG. 4 are denoted by like reference numerals but increased by 100, a handle assembly 400 of a fourth embodiment of the invention has a pair of handles 408 mounted to a support 450 which can pivot about axis 452 relative to a body portion 402. A compression spring 446 urges the handles 408 upwards relative to the body 402, and vibration damping elastomeric material (not shown) is provided between support 450 and body 402 around axis 452 and between projection 454 on body 402 and support 450.

Figure 6:
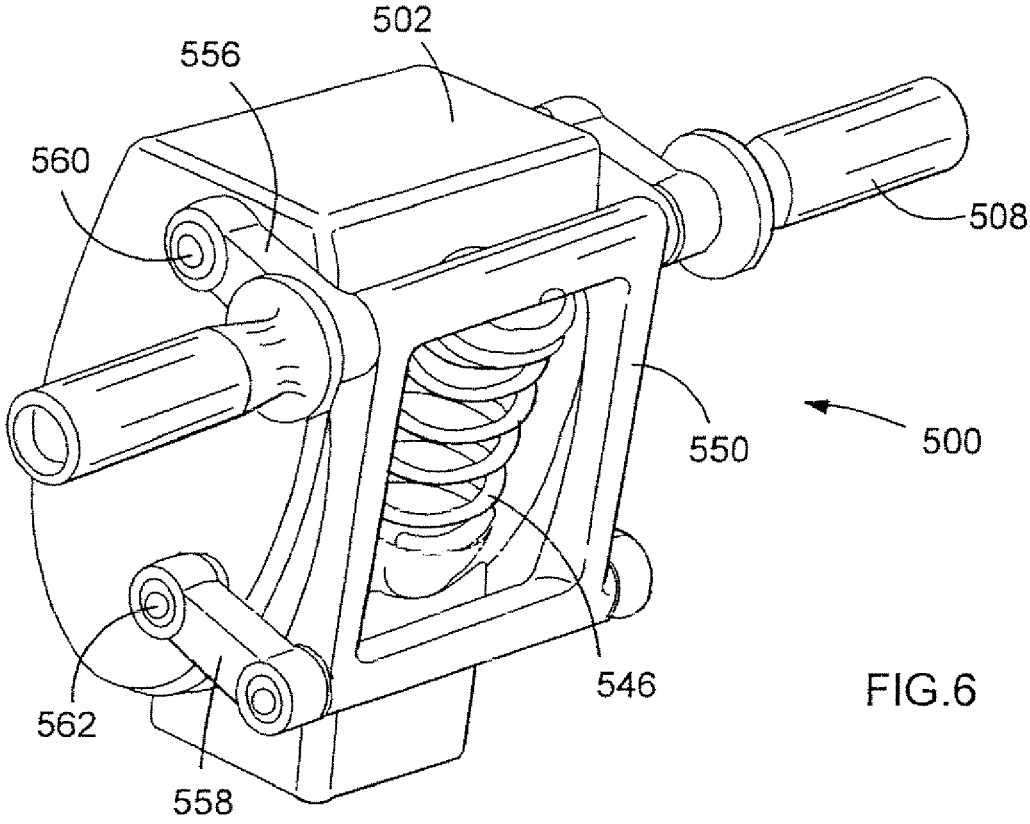
FIG. 6 shows a handle assembly of a fifth embodiment of the present invention.

Referring now to FIG. 6, in which parts common to the embodiment of FIG. 5 are denoted by like reference numerals but increased by 100, a handle assembly 500 of a fifth embodiment of the invention differs from the arrangement of FIG. 5 in that the support 450 mounted via a single pivot 452 is replaced by a support 550 mounted via generally parallel links 456, 458 mounted about respective axes 460, 462 to form a parallelogram linkage. In this way, movement of handles 508 relative to the body 502 causes compression of spring 546, but the parallelogram linkage formed by links 556, 558 prevents bending of compression spring 546.

Figure 7:
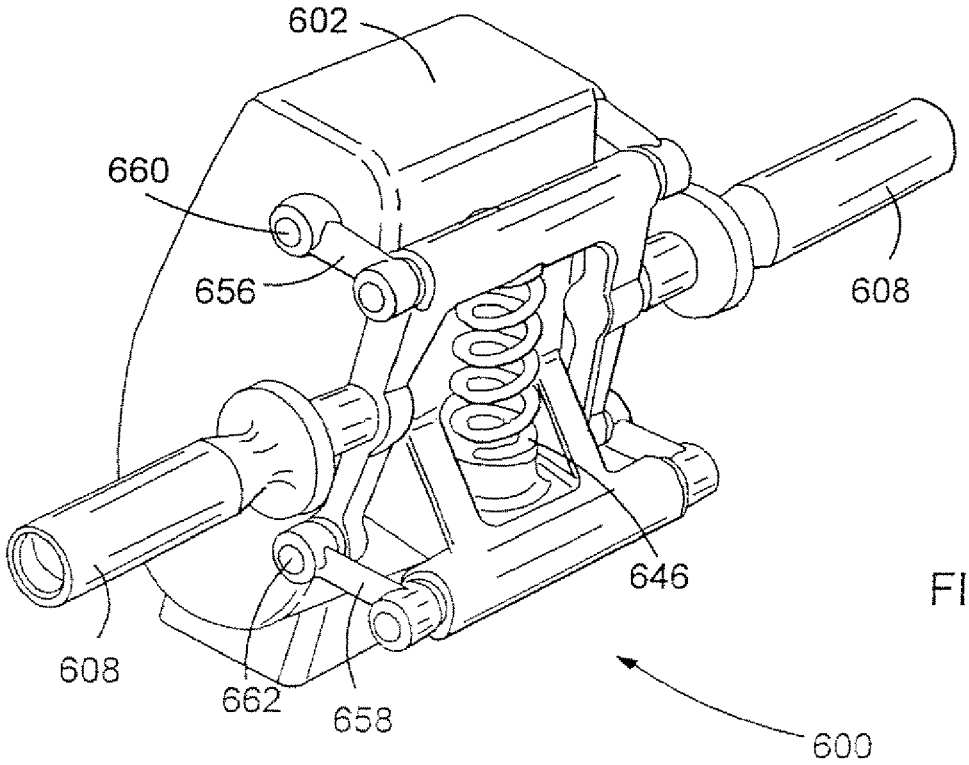
FIG. 7 shows a handle assembly of a sixth embodiment of the present invention.

Bending of the compression spring is minimised in a similar manner in a sixth embodiment of the invention, shown in FIG. 7, in which parts common to the embodiment of FIG. 6 are denoted by like reference numerals but increased by 100. The parallelogram linkage formed by links 556, 558 is replaced by a Z-shaped linkage formed by links 656, 658 rotating about axes 660, 662 respectively, such that movement of handles 608 relative to body 602 does not cause bending of compression spring 646.

Figure 8:
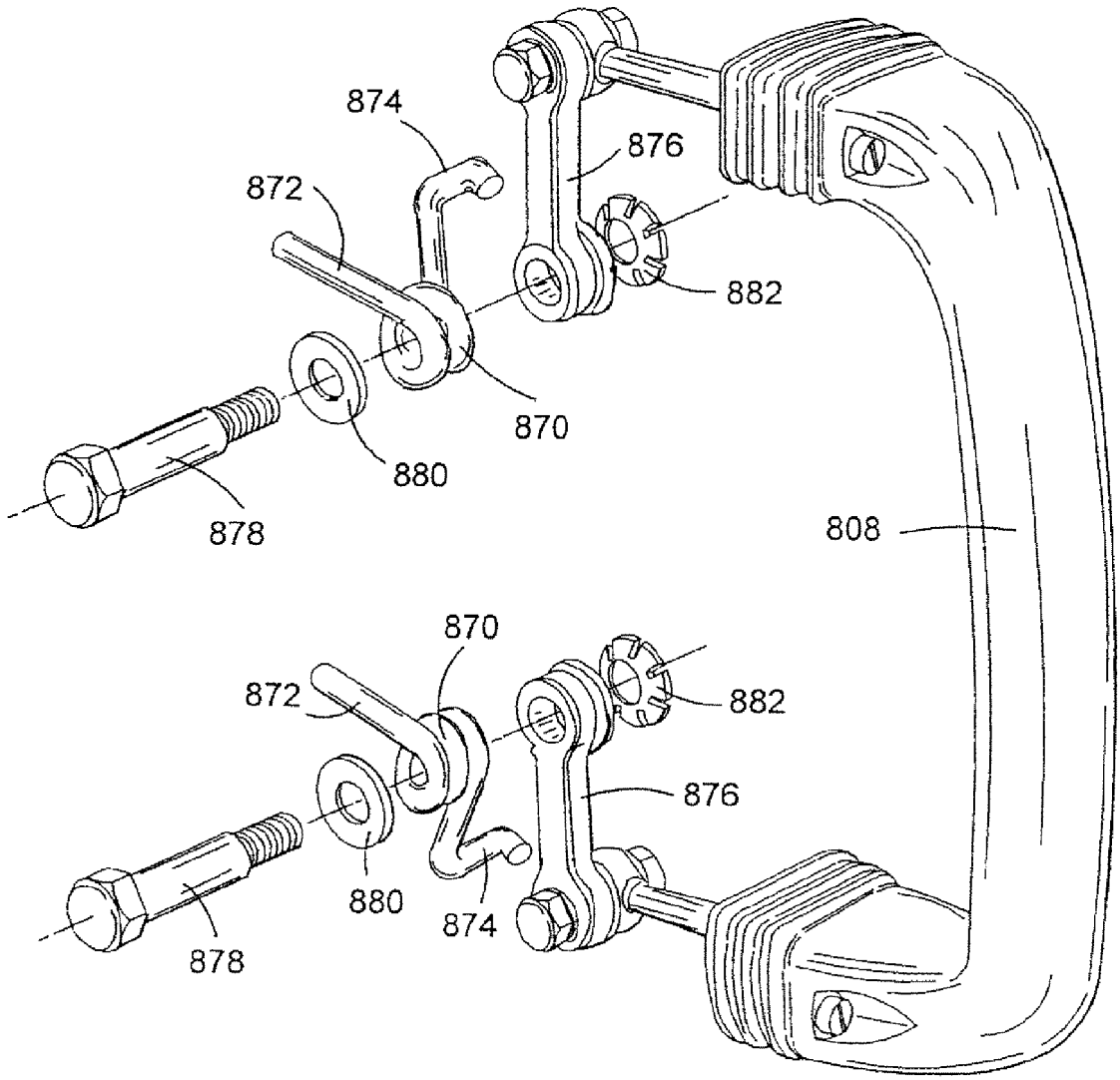
FIG. 8 shows a handle assembly of a seventh embodiment of the present invention.

FIG. 8 shows a handle assembly of a seventh embodiment of the present invention, in which a pair of handles 808 (only one of which is shown in FIG. 8) is mounted to a housing (not shown) of a power hammer by means of a pair of torsion springs 870 having arms 872, 874 abutting the housing and links 876 connected to the handle 808 such that vibrations generated in the power hammer cause bending of torsion springs 870, and are therefore not transmitted to the handle 808. The springs 872 are mounted to the housing of the power hammer by means of respective bolts 878, washers 880 and washers 882.

It will be appreciated by persons skilled in the art that the above embodiments have been described by way of example only and not in any limitative sense, and that various alterations and modifications are possible without departure from the scope of the invention as defined by the appended claims.

The invention claimed is:

1. A handle assembly for a power tool, the handle assembly comprising:

attachment means for attaching the handle assembly to a housing of a power tool;

handle means adapted to be held by a user of the power tool, wherein the handle means is mounted to said attachment means and is capable of limited movement relative to the housing of the power tool; and vibration damping means acting between said housing and said handle means; and wherein the vibration damping means comprises elastomeric material; and wherein the attachment means is mounted in use to the housing via at least one bolt on one of the attachment means and the housing passing through a respective aperture in the other of said attachment means and the housing, said bolt defining a first axis, wherein at least some of the elastomeric material is arranged in use between at least one said bolt and a corresponding said aperture; and wherein the handle means comprises a pair of handles, each said handle being mounted to said attachment means via a respective pair of apertures defining respective second and third axes that are non-parallel with respect to the first axis, wherein at least some of the elastomeric material is also arranged in use between said handle means and said pair of apertures.

2. An assembly according to claim 1, wherein the handle means is pivotable relative to said attachment means.

3. A handle assembly for a power tool, the handle assembly comprising:

attachment means for attaching the handle assembly to a housing of a power tool;

handle means adapted to be held by a user of the power tool, wherein the handle means is mounted to said attachment means and is capable of limited movement relative to the housing of the power tool; and vibration damping means acting between said housing and said handle means; and wherein the vibration damping means comprises elastomeric material; and wherein the attachment means is mounted in use to the housing via at least one bolt on one of the attachment means and the housing passing through a respective aperture in the other of said attachment means and the housing, said bolt defining a first axis, wherein at least some of the elastomeric material is arranged in use between at least one said bolt and a corresponding said aperture; and wherein the handle means comprises a pair of handles, each said handle being mounted through said attachment means via a respective pair of apertures defining respective second and third axes that are non-parallel with respect to the first axis, wherein at least some of the elastomeric material is also arranged in use between said handle means and said pair of apertures.

* * * * *